United States Patent [19]

Jensen

[11] 4,290,094

[45] Sep. 15, 1981

[54] UNDERWATER OR WEATHERPROOF LIGHT

[76] Inventor: Henning Jensen, 13 Peter Parade, Mermaid Beach, Queensland, Australia, 4218

[21] Appl. No.: 139,811

[22] Filed: Apr. 14, 1980

[51] Int. Cl.[3] ..... F21V 31/02

[52] U.S. Cl. ..... 362/145; 362/267; 362/293

[58] Field of Search ..... 362/145, 147, 267, 390, 362/293; 43/17.5; 9/8.3 E

[56] References Cited

U.S. PATENT DOCUMENTS

| | | | |
|---|---|---|---|
| 3,339,066 | 8/1967 | Hart | 362/267 |
| 3,617,733 | 11/1971 | Adams et al. | 362/267 |
| 3,626,173 | 12/1971 | Harvey | 9/8.3 E |
| 3,833,955 | 9/1974 | Hulbert | 9/8.3 E |
| 3,864,562 | 2/1975 | Hawkins | 362/267 |

FOREIGN PATENT DOCUMENTS

| | | | |
|---|---|---|---|
| 1175962 | 10/1967 | United Kingdom | 362/267 |

*Primary Examiner*—L. T. Hix
*Assistant Examiner*—Alan Mathews
*Attorney, Agent, or Firm*—Schwartz, Jeffery, Schwaab, Mack, Blumenthal & Koch

[57] ABSTRACT

An underwater light which is fitted to the walls of swimming pools or tanks and is immersed in water. The electrical wires are connected to respective contact pins on the rear of the light and are individually sealed with a polyurethane varnish or silicon rubber over which are shrunk head-shrinkable rubber or plastic sleeves. The light may be recessed in the walls of the pools or tanks or may be fitted to suitable mounting blocks.

9 Claims, 2 Drawing Figures

UNDERWATER OR WEATHERPROOF LIGHT

Figure 1:
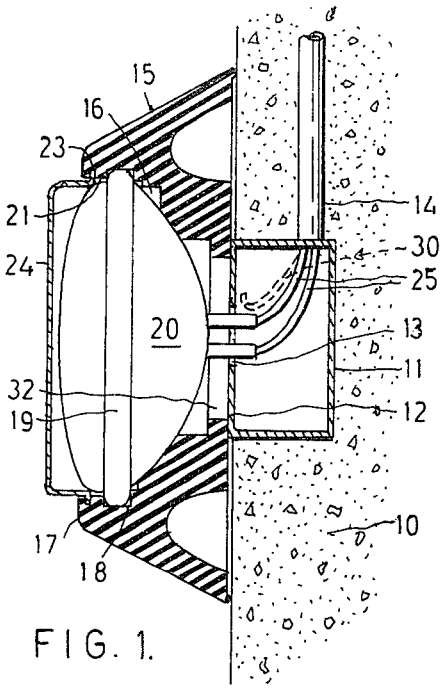

BACKGROUND OF THE INVENTION (1) Field of the Invention

This invention relates to a light which is adapted for immersion in water.

(2) Description of the Prior Art

There are a large number of applications for lights which are required to operate below the water level, e.g. in swimming pools, boatramps, slipways and naval testing tanks. The difficulty with such applications is the important requirement that any swimmer in contact with the water does not receive a fatal or paralysing shock if a power leakage from the light occurs.

To try to overcome this problem, the lamps are usually provided in boxes or recesses provided with a transparent panel. This has not proved successful as it is extremely difficult, if not impossible, to ensure and maintain a watertight seal between the panel and the box or recess to prevent ingress of water into the box or recess. When the water enters the box or recess and comes into contact with the electrical wiring, either the protection fuse or the lamp are blown. At the same time, an electric current may pass through the water which is sufficient to paralyse an operator and cause him to drown. Elaborate gaskets and seals have been proposed to provide a watertight seal but all of these are prone to failure and it is difficult to re-establish the seal if the panel has to be removed and refitted, e.g. to enable a blown lamp to be replaced.

BRIEF SUMMARY OF THE INVENTION

The object of the present invention is to avoid the need for sealing the panel to the box or recess.

A preferred object is to provide a light where the lamp may be wholly or partly immersed in the water while keeping the water out of contact with the electrical wiring.

A further preferred object is to provide a suitable mounting which allows the lamp to be easily fitted into, or removed therefrom.

In a broad aspect, the present invention resides in a light adapted for immersion in water and connectable to an electrical supply means by a conduit, said light including:

a non-sealing lamp mounting member;

a sealed beam electric lamp having at least a pair of filament contact posts on the rear thereof;

means retaining the lamp in the mounting member whereby the exterior of the lamp may be exposed to direct contact with water;

a waterproof insulated conductor wire electrically connected to each of the filament contact posts and extending through the conduit;

a small mass of waterproof material completely enclosing and sealing each filament contact post and respective electrical connection between the filament contact post and its respective conductor wire; and a heat-shrinkable sleeve shrunk over each respective mass of waterproof material/contact filament post-/electrical connection combination.

Preferably the waterproof material includes a polyurethane-gloss varnish and/or a silicone rubber.

Preferably the heat shrinkable sleeve is formed of a heat-shrinkable rubber or plastic, e.g. irradiated cross-linked polyolefins.

Preferably the mounting means includes a mounting block of flexibly resilient material; a cavity in the front face of the mounting block to receive and support the lamp; an aperture in communication with the cavity and the rear face of the mounting block to receive the conduit from a conduit box in a support surface; and means to mount the mounting block on the support surface.

Preferably the lamp retaining means includes a peripheral groove around the cavity spaced rearwardly from the front face of the mounting block to receive a peripheral rim on the lamp.

The mounting block may be formed from, e.g. natural or synthetic rubber, flexible PVC, polyurethane or neoprene.

The lamp may be an aircraft landing lamp or vehicle driving lamp of suitable voltage and power capacity for the application.

BRIEF DESCRIPTION OF THE SEVERAL VIEW OF THE DRAWINGS

Figure 2:
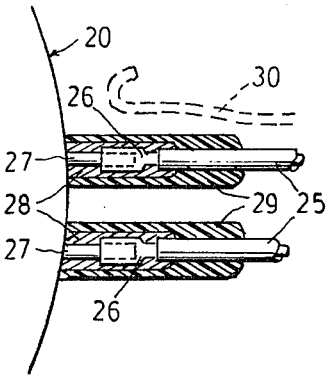

To enable the invention to be fully understood, a preferred embodiment will now be described with reference to the accompanying drawings, in which:

FIG. 1 is a part-sectional side view of the light fitted to a swimming pool wall; and FIG. 2 shows a sectional view of the sealing of the electrical connections in more detail.

Referring to FIG. 1, the swimming pool wall 10 has a recess formed by an electrical conduit box 11 cemented in place. The box 11 has a lid 12, with a hole 13 therethrough which is secured in place by suitable fasteners (not shown). A conduit pipe 14 is cemented in place in the wall 10 and enters a side wall of the box 11. A mounting block 15, of frustrate conical section, is formed of rubber (or flexible PVC, polyurethane or neoprene material) and has a substantially central concave cavity 16 open to the outer face 17 of the block 15. A peripheral groove 18 is formed around the cavity 16 a small distance below the outer face 17 and is adapted to engage the peripheral rim 19 of a sealed beam lamp 20 mounted in the cavity 16. The lip 21 between the groove 18 and outer face 17 is flexible to enable the rim 19 of the lamp 20 to be moved into, or out of, supporting engagement with the groove 18.

The block 15 has a hole 32 through its base in registry with the hole 13 in the conduit box lid 12 to receive the electrical connections to be described hereinafter. The block 15 is secured to the conduit box lid 12 by suitable fasteners (not shown) passing through holes (not shown) spaced about the hole 32 in the base.

A groove 23 may be provided between the outer face 17 and groove 18 to releasably secure a coloured screen 24 provided to create a particular aesthetic effect.

Referring to FIGS. 1 and 2, electrical current at a voltage of, e.g. 12 to 32 volts (preferably 24 V.D.C.) is conducted from the secondary side of a transformer (not shown) to the lamp 20 by insulated wires 25 passing through the conduit pipe 14 and conduit box 1. Each wire 25 has an electrical connector 26 which engages a respective filament contact post 27 extending from the rear of the lamp (see FIG. 2). Polyurethane-gloss varnish 28 (or, alternatively, silicon rubber e.g. of the type sold under the Trade Mark "Silastic") is deposited around the filament posts 27 and a sleeve 29 of heat-shrinkable rubber or plastic (e.g. sold under the Trade Mark Raychem TCS "Thermofit") is provided around each connector 26/filament contact post 27/sealant 28 combination and shrunk into position.

The combination of the varnish or silicon rubber sealant 28 and the heat-shrunk sleeve 29 forms a watertight seal about each connection. In the pool, the lamp 20 is fully or partially surrounded by water but the connections are kept watertight. As only the connections must be sealed, it is much easier and simpler to keep them watertight than the complete box or recess on known lighting assemblies.

As an added safety measure, a trip sensor may be fitted on the secondary side of the transformer where the trip is operable to shut off any power to the lamp if the sensor detects any imbalance in the power being conducted from the transformer, e.g. should water come into contact with one of the electrical connections. A sensor wire 30 (shown in dashed lines) may terminate in a coil or loop spaced from the contact filament posts 27. If water does reach either filament contact post 27, the current passing through the water will be detected by the sensor wire 30, causing the trip sensor to operate.

Should the lamp 20 fail, it can be easily removed from the mounting block 15 and replaced by a new lamp. As the lamps are off-the-shelf items, they are relatively inexpensive to replace.

Various modifications and changes may be made to the arrangements described without departing from the scope of the present invention.

I claim:

1. A light adapted for immersion in water and connectable to an electrical supply means by a conduit, said light including:

a non-sealing lamp mounting means;

a sealed beam electric lamp having at least a pair of filament contact posts on the rear thereof;

means retaining the lamp in the mounting means whereby the exterior of the lamp may be exposed to direct contract with water;

a waterproof insulated conductor wire electrically connected to each of the filament contact posts and extending through the conduit;

a small mass of waterproof material completely enclosing and seaing each filament contact post and respective electrical connection between the filament contact post and its respective conductor wire; and a heat-shrinkable sleeve shrunk over said small mass of waterproof material which encloses and seals the connections between said filament contact posts and conductor wires.

2. A light as claimed in claim 1 wherein:

the masses of waterproof material include a polyurethane-gloss varnish.

3. A light as claimed in claim 1 wherein:

the masses of waterproof material include a silicone rubber.

4. A light as claimed in claim 1 wherein:

the heat-shrinkable sleeve is formed of heat-shrinkable rubber.

5. A light as claimed in claim 1 wherein:

the heat-shrinkable sleeve is formed of heat-shrinkable plastic.

6. A light as claimed in claim 5 wherein:

the heat-shrinkable plastic includes irradiated cross-linked polyolefins.

7. A light as claimed in any one of claims 1 to 6 wherein the mounting means includes:

a mounting block of flexibly resilient material;

a cavity in the front face of the mounting block to receive and support the lamp;

an aperture in the rear face of said block;

a conduit box mounted in a supporting surface and formed with a lid having openings therein registering with the aperture in the rear face of said block;

said insulated conductor wires extending through a side wall of said conduit box and through said openings in said lid, for electrical connection to said filament contact posts of said lamp which extend through said aperture in said block, and means for mounting block on said conduit box.

8. A light as claimed in claim 7 wherein:

the lamp retaining means includes a peripheral groove around the cavity spaced rearwardly from the front to receive a peripheral rim on the lamp.

9. A light as claimed in claim 8, wherein a peripheral groove is formed adjacent to the front face of the mounting block, and screen means mounted in said groove in front of said lamp.

* * * * *